US010085555B2

(12) United States Patent
Prine, III

(10) Patent No.: US 10,085,555 B2
(45) Date of Patent: Oct. 2, 2018

(54) TABLE ASSEMBLY

(71) Applicant: George E. Prine, III, Minneapolis, MN (US)

(72) Inventor: George E. Prine, III, Minneapolis, MN (US)

( * ) Notice: Subject to any disclaimer, the term of this patent is extended or adjusted under 35 U.S.C. 154(b) by 0 days.

(21) Appl. No.: 15/272,537

(22) Filed: Sep. 22, 2016

(65) Prior Publication Data

US 2018/0078037 A1 Mar. 22, 2018

(51) Int. Cl.
*A47B 83/02* (2006.01)

(52) U.S. Cl.
CPC ..... *A47B 83/024* (2017.08)

(58) Field of Classification Search
CPC ..... A47B 83/02; A47B 83/024; A47B 3/063; A47B 3/14
USPC ..... 297/135, 158.3, 158.4
See application file for complete search history.

(56) References Cited

U.S. PATENT DOCUMENTS 4,607,880 A * 8/1986 Gastebled ..... A47B 3/14 108/155
5,224,753 A * 7/1993 Fox ..... A47B 3/14 108/101
5,330,247 A * 7/1994 Fricke ..... A47B 7/00 297/158.3
6,007,147 A * 12/1999 McCracken ..... A47B 83/02 297/158.3
6,099,074 A * 8/2000 Wallace, III ..... A47B 3/14 108/132
6,142,560 A * 11/2000 Miller ..... A47B 3/14 297/158.4
6,186,590 B1 * 2/2001 Tseng ..... A47B 3/14 297/108
7,717,045 B2 * 5/2010 Robinson ..... A47B 3/083 108/115
8,684,453 B2 * 4/2014 Furst ..... A47B 3/14 296/26.08
8,740,299 B1 * 6/2014 Hall ..... A47B 83/02 297/135
2007/0075573 A1 * 4/2007 Gray ..... A47B 83/02 297/158.3
2014/0008944 A1 * 1/2014 Anderson ..... A47B 83/02 297/158.4

* cited by examiner

*Primary Examiner* — Jose V Chen

(57) ABSTRACT

A table assembly includes a tabletop having a first end and a second end and a pair of bench panels each having a first end and a second end. A first support and a second support is provided. Each of the first and second supports has a unitary structure. The first support is coupled to each of the first ends of the tabletop and the bench panels. The second support is coupled to each of the second ends of the tabletop and the bench panels. Each of the bench panels is positioned below and outwardly laterally spaced from the tabletop. The tabletop and the bench panels are horizontally oriented and the bench panels are coplanar.

16 Claims, 6 Drawing Sheets

TABLE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to table and bench combination devices and more particularly pertains to a new table and bench combination device for providing a table having an attached but easily accessible bench component.

BRIEF SUMMARY OF THE INVENTION

An embodiment of the disclosure meets the needs presented above by generally comprising a tabletop having a first end and a second end and a pair of bench panels each having a first end and a second end. A first support and a second support is provided. Each of the first and second supports has a unitary structure. The first support is coupled to each of the first ends of the tabletop and the bench panels. The second support is coupled to each of the second ends of the tabletop and the bench panels. Each of the bench panels is positioned below and outwardly laterally spaced from the tabletop. The tabletop and the bench panels are horizontally oriented and the bench panels are coplanar.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
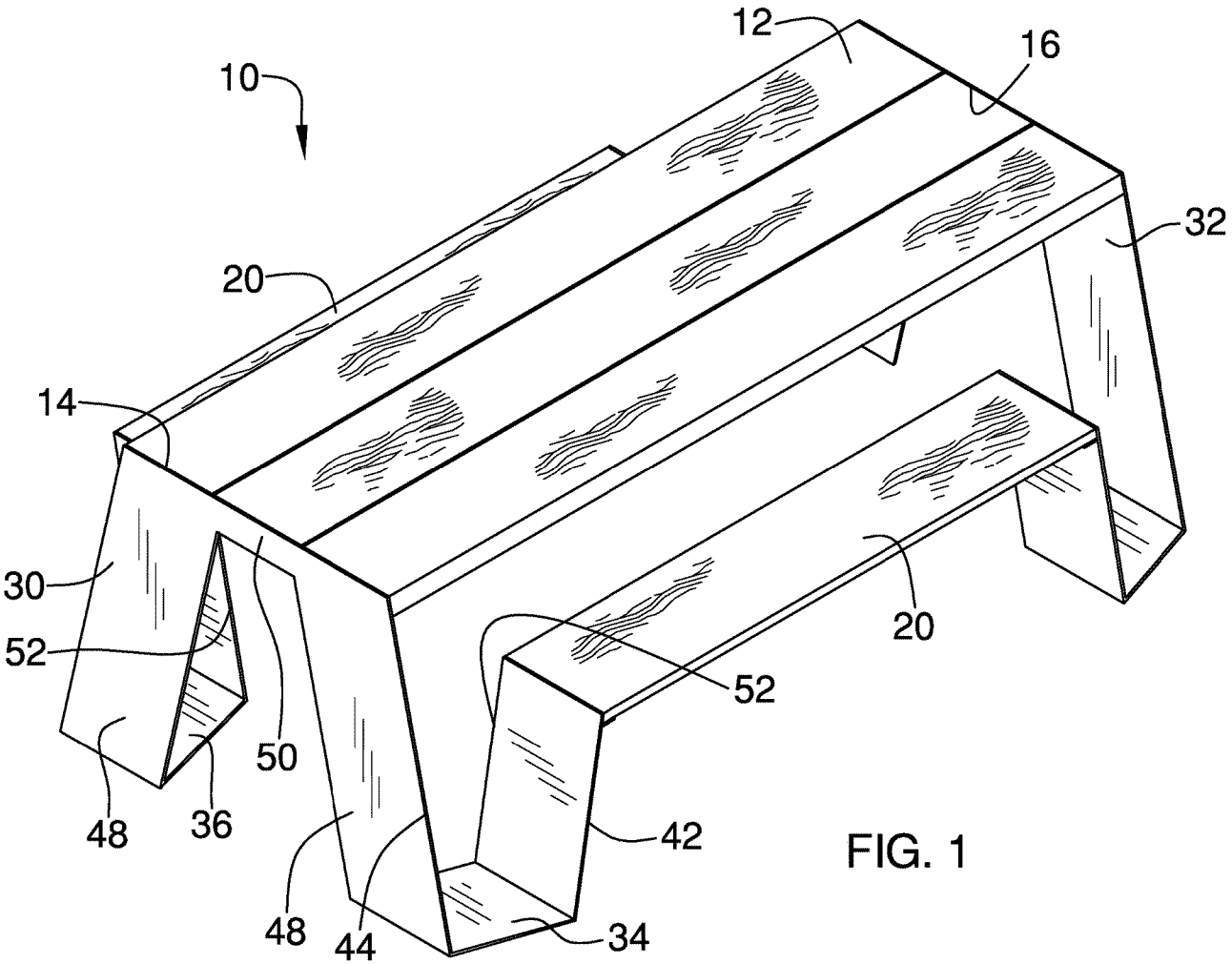
FIG. 1 is a to perspective view of a table assembly according to an embodiment of the disclosure.
Figure 2:
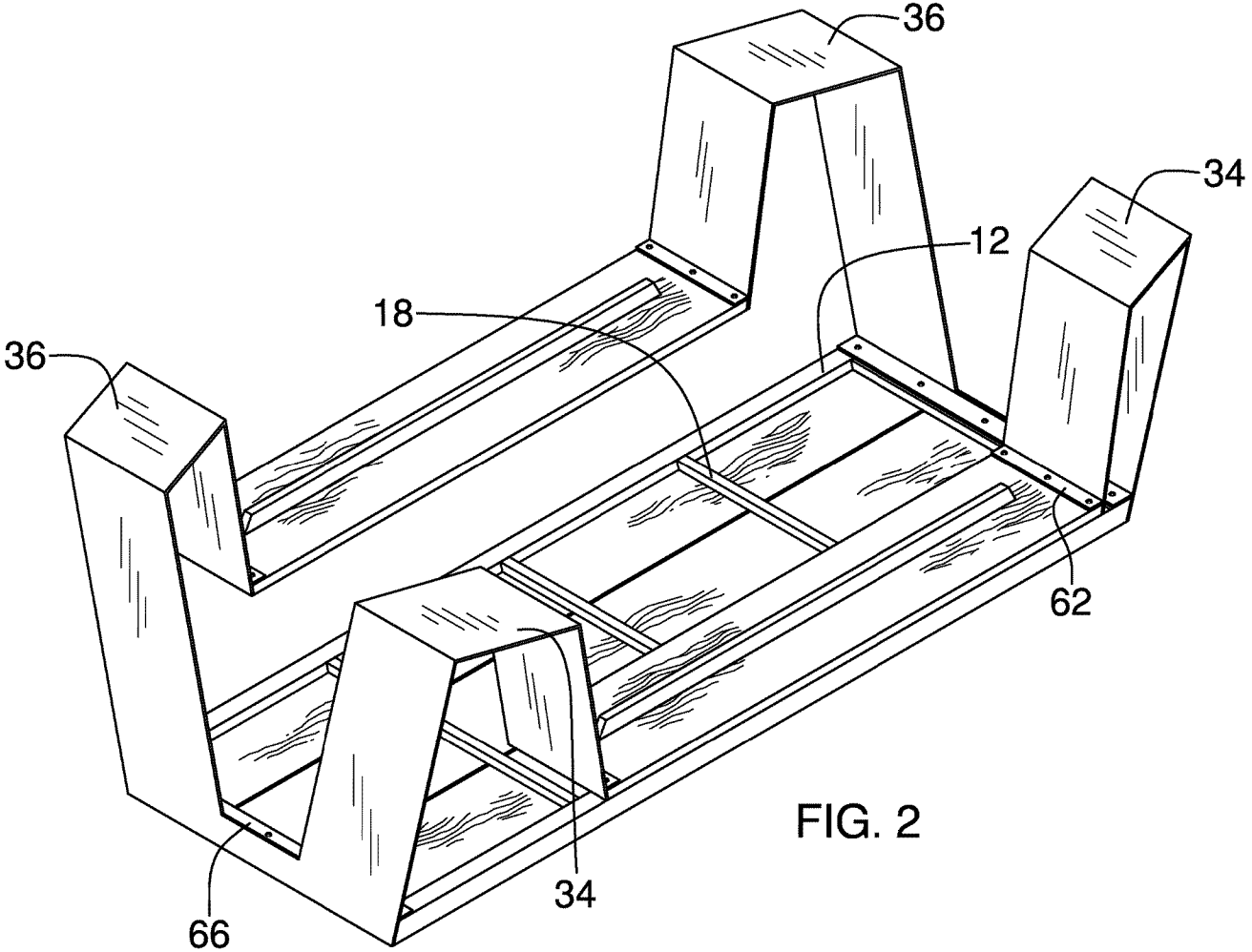
FIG. 2 is a bottom perspective view of an embodiment of the disclosure.
Figure 3:
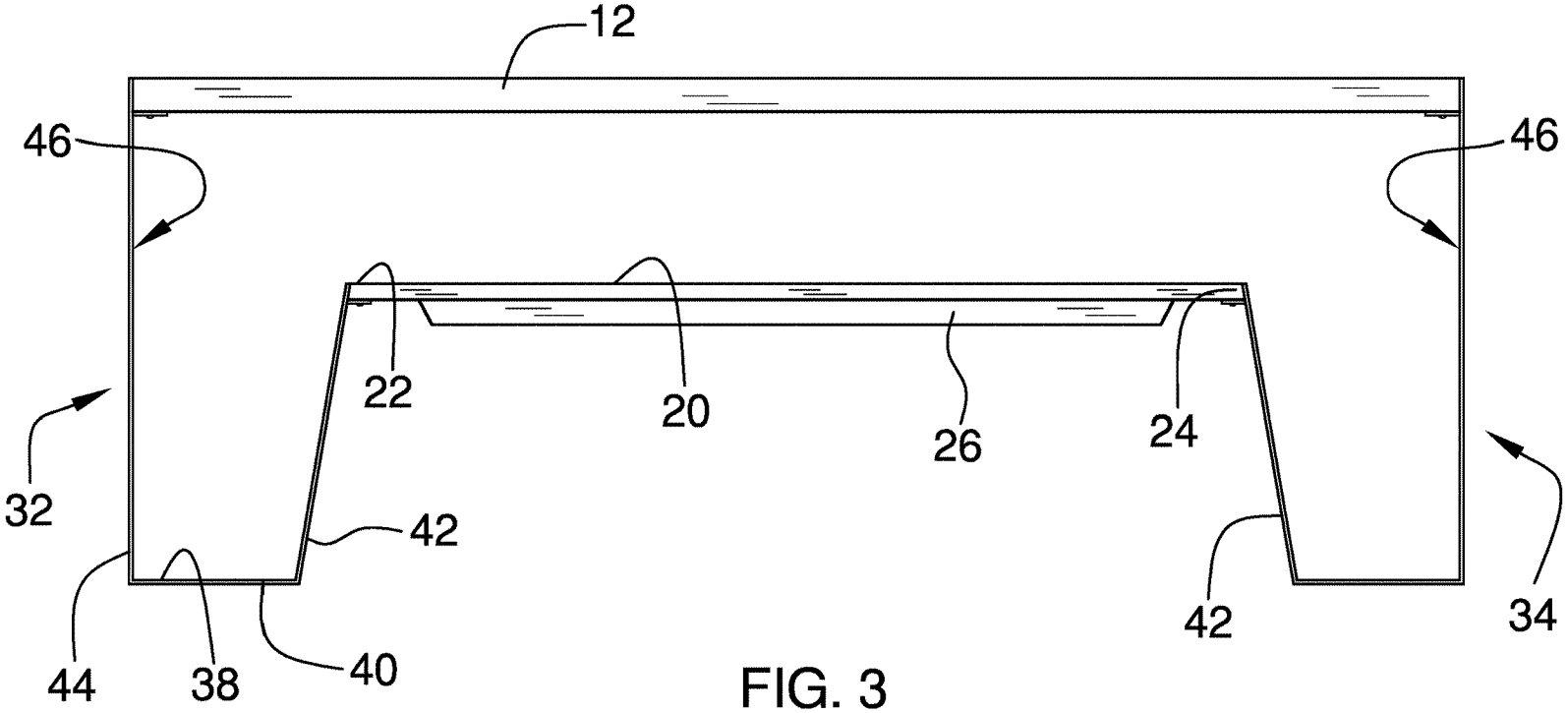
FIG. 3 is a side view of an embodiment of the disclosure.

With reference now to the drawings, and in particular to FIGS. 1 through 6 thereof, a new table and bench combination device embodying the principles and concepts of an embodiment of the disclosure and generally designated by the reference numeral 10 will be described.

As best illustrated in FIGS. 1 through 6, the table assembly 10 generally comprises a tabletop 12 that has a first end 14 and a second end 16. The tabletop 12 is shown as comprising a plurality of planks however the tabletop 12 may include a single plank or a plurality of planks and may further include crossbeams 18 for additional support as needed. A pair of bench panels 20 is provided and each of the bench panels 20 has a first end 22 and a second end 24. The bench panels 20, as with the tabletop 12, may comprise one or more planks and may further include strengthening members 26 as needed to prevent the bowing of the bench panels 20 when they are sat upon.

A first support 30 and a second support 32 are provided and each has a unitary structure. The term "unitary structure" is intended to mean that the first 30 and second 32 supports are formed as a single piece of material, unless stated explicitly below, such that they may be formed by molded plastics, metals or the like or may be fabricated out of sections that are joined by welding or other processes that do not allow for the sections thereof to be removed from each other. The first support 30 is coupled to each of the first ends 14, 22 of the tabletop 12 and the bench panels 20, respectively. The second support is coupled to each of the second ends 16, 24 of the tabletop 12 and the bench panels 20. Each of the bench panels 20 is positioned below and outwardly laterally spaced from the tabletop 12. Each of the tabletop 12 and the bench panels 20 is horizontally oriented and the bench panels 20 are coplanar with each other. The tabletop 12 and the bench 20 panels may be positioned entirely between the first 30 and second 32 supports as can be seen in FIG. 1.

The first 30 and second 32 supports have generally identical construction and each comprises a first base 34 and a second base 36. Each of the first 34 and second 36 bases has a top side 38 and a bottom side 40 wherein the bottom side 40 is configured to be abutted against a ground surface. The top 38 and bottom 40 sides may each be planar and each of the first 34 and second 36 bases has a height is less than 2.0 inches to facilitate clearance by a person moving onto or off of the bench panels 20. The first 30 and second 32 supports also include a pair of seat risers 42 such that each of the first 34 and second 36 bases has one of the seat risers 42 integrally coupled thereto. The seat risers 42 extend upwardly from an associated one of the top sides 38. Each one of the bench panels 20 extends between and is attached to one of the seat risers 42 of the first support 30 and one of the seat risers 42 of the second support 32 such that each of the seat risers 42 has one of the bench panels 20 attached thereto. The first 30 and second 32 supports each further comprise table riser 44 that is attached to each of the first 34 and second 36 bases and extends upwardly from the top sides 38. The tabletop 12 is attached to the table riser 44 and extends away from an internal surface 46 of the table riser 44 such that the tabletop 12 extends between internal surfaces of the first 30 and second 32 supports. The table riser 44 may be formed into two legs 48 being angled and extending outwardly from each a central beam 50. The table riser 44, seat risers 42 and bases 34, 36 may all be comprised of rigid sheets of thin material and which may include plastics, composites, metals and the like.

The seat risers 42 face and are laterally spaced from the internal surface 46 of the table riser 44. A distance between the seat risers 42 and the table riser 44 adjacent to an associated one of the first 34 and second 36 bases is greater than 4.0 inches and is configured to allow a person's foot to move between the seat risers 42 and the table riser 44. Thus, when a person is going to use the assembly 10, they will be able turn their body and slide their legs through the opening formed between the seat 42 and table 44 risers without concern of catching their feet or legs on framework typically found with conventional picnic tables. The seat risers 42 may be angled away from table risers 44 as the seat risers 42 extend upwardly from an associated one of the first 34 and second 36 bases so that an angle formed a juncture of the top sides 38 and the seat risers 42 is an obtuse angle. This angle provides additional leg clearance for the user of the assembly 10.

Figure 4:
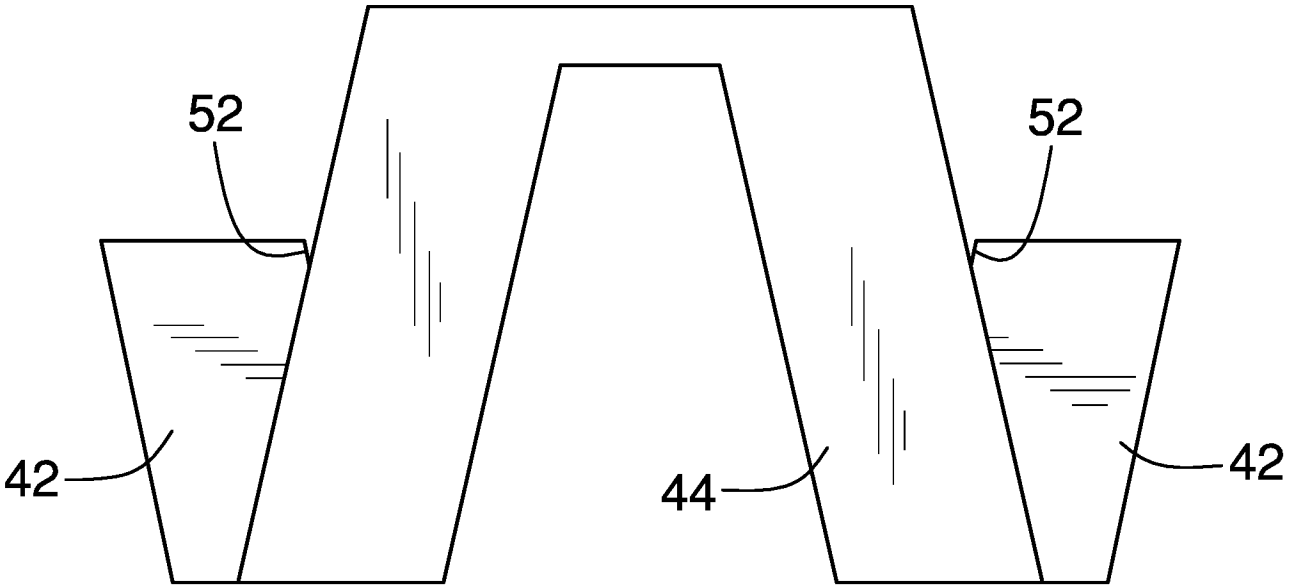
FIG. 4 is an end view of an embodiment of the disclosure.
Figure 5:
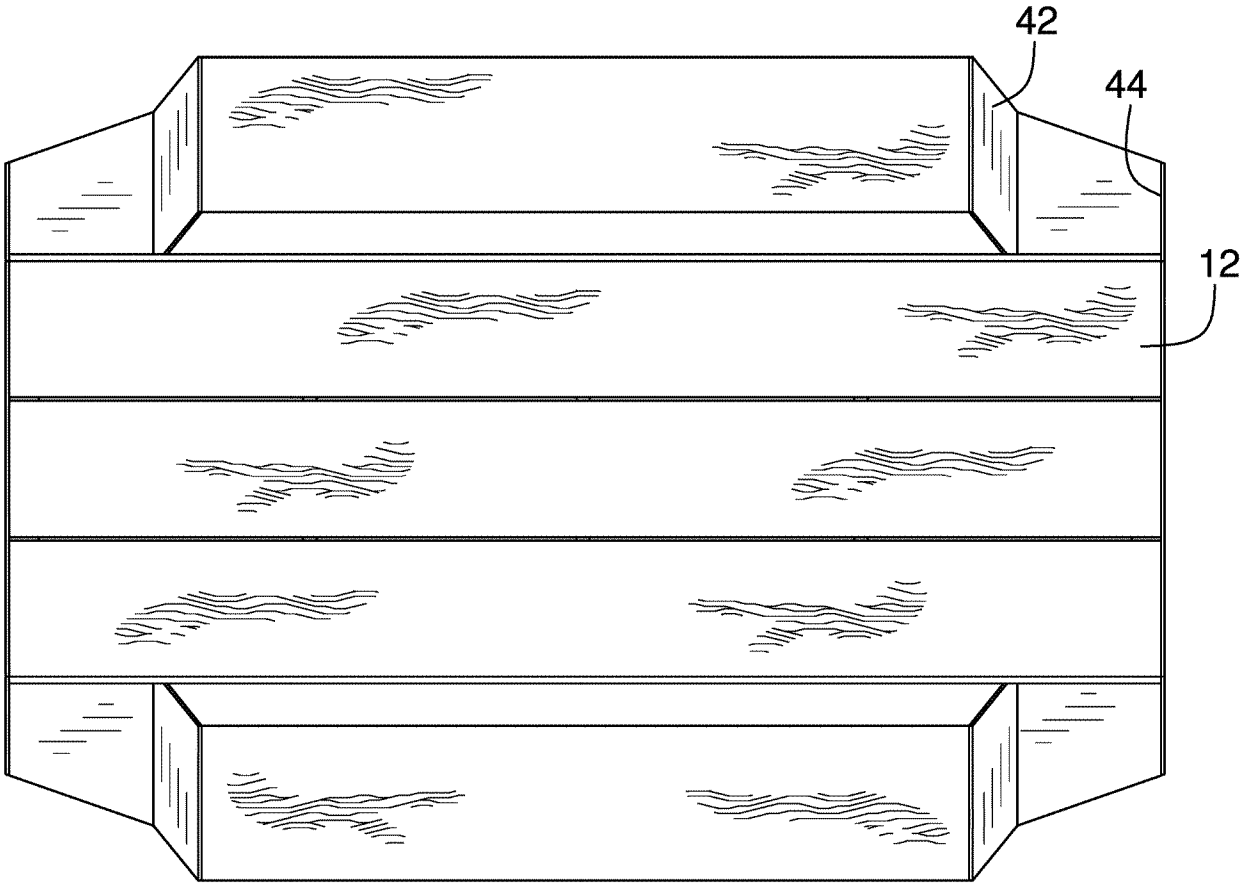
FIG. 5 is a top view of an embodiment of the disclosure.
Figure 6:
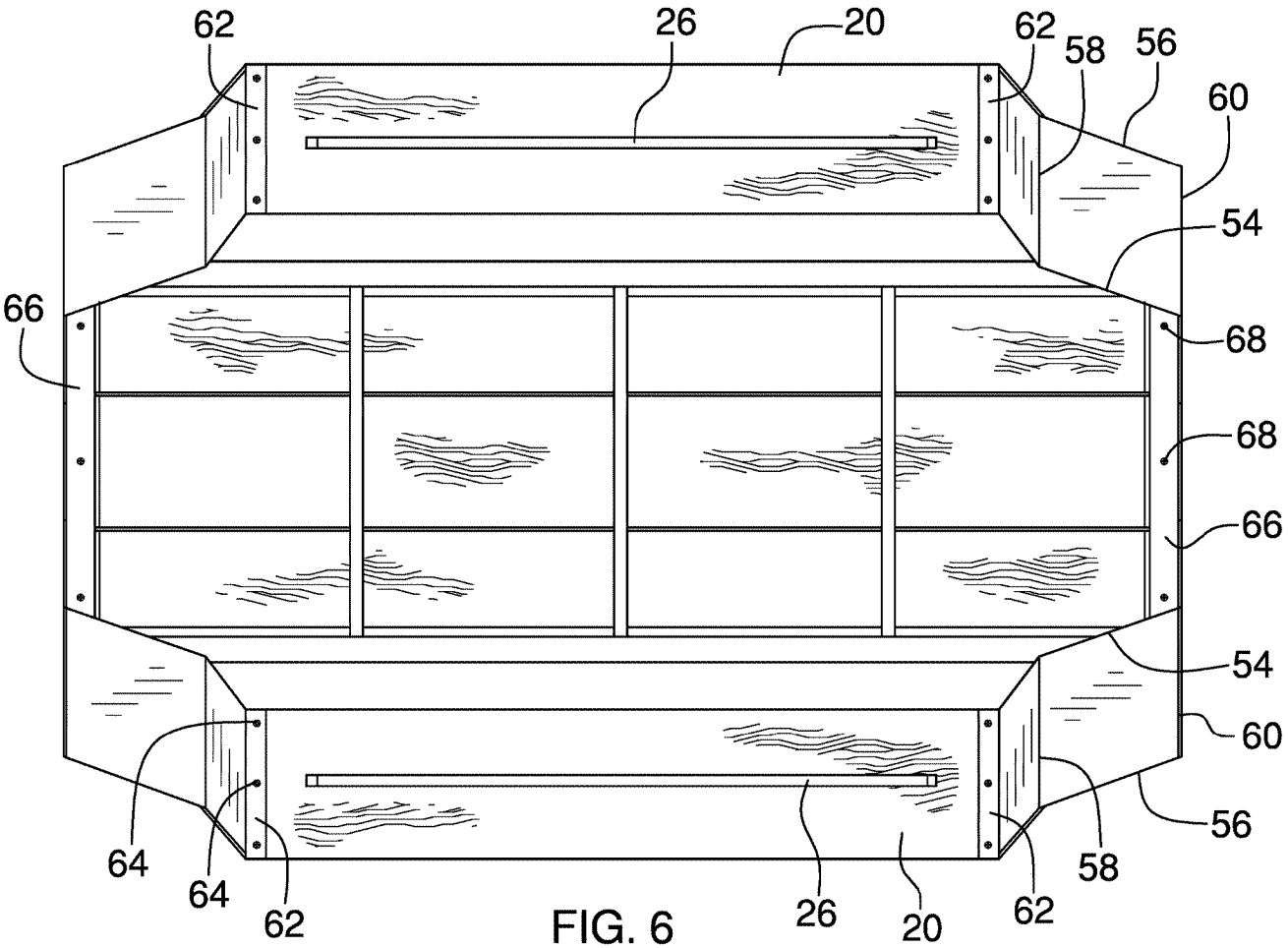
FIG. 6 is a bottom view of an embodiment of the disclosure.

Finally, each of the seat risers 42 may be angled outwardly away from the tabletop 12 as the seat risers 42 extend upwardly from an associated one of the first 34 and second 36 bases to laterally displace the bench panels 20 from the tabletop 12 as shown in FIG. 4. The seat risers 42 have an inner edge 52 facing each other and which are angled away from each other as they move upwardly from the first 34 and second 36 bases. Each of the top sides 38 of first 34 and second 36 bases has an interior edge 54, an exterior edge 56, a seat edge 58 and a table edge 60. The interior edges 54 of the top sides 38 face each other whereas the seat edges 58 are attached to an associated one of the seat risers 42 and the table edges 60 are attached to the table riser 44. As shown in FIG. 6, a juncture of the interior edges 54 and the seat edges 58 forms an obtuse angle and a juncture of the interior edges 54 and the table edges 60 forms an acute angle.

A pair of flanges 62 is provided with each of the first 30 and second 32 supports and each may or may not be part of the unitary structure of the first 30 and second 32 supports. Each of the seat risers 42 has one of the flanges 62 attached thereto and positioned adjacent to an upper edge thereof. The bench panels 20 are positioned on an associated one of the flanges 62 and a plurality of fasteners 64, not integral to the first 30 and second 32 supports, extends through the flanges 62 and into the bench panels 20. The flanges may be positioned relative to the upper edges such that a top side of bend panels are approximately flush with the upper edges. A shelf 66 is attached to the table riser 44 and may or may not be integral with the first 30 and second 32 supports. The shelf 66 is positioned adjacent to an apex of the table riser 44 and the tabletop 12 is positioned on the shelf 66. A plurality of fasteners 68, again not integral to the first 30 and second 32 supports, extends through the shelf 66 and into the tabletop 12.

In use, the assembly 10 may be used as a conventional table and bench combination device. However, the first 30 and second 32 supports facilitate the usage of the assembly 10 as well as promote an efficient design as one constructing the assembly 10 will only require the first 30 and second 32 supports, tabletop 12 and bench panels 20. The assembly 10 is thereby simple to construct while providing adequate support and improved usage characteristics.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A table assembly comprising:

a tabletop having a first end and a second end;

a pair of bench panels, each of said bench panels having a first end and a second end, said tabletop have a first length dimension from said first end to said second end of said tabletop, said bench panels having a second length dimension from said first ends to said second ends of said bench panels, said first length dimension being greater than said second length dimension;

a first support and a second support, each of said first and second supports having a unitary structure, said first support being coupled to each of said first ends of said tabletop and said bench panels, said second support being coupled to each of said second ends of said tabletop and said bench panels, each of said bench panels being positioned below and outwardly laterally spaced from said tabletop, each of said tabletop and said bench panels being horizontally oriented, said bench panels being coplanar; and each of said first and second ends of said tabletop and said pair of benches being positioned entirely between said first and second supports.

2. The table assembly according to claim 1, wherein said first and second supports each comprise:

a first base and a second base, each of said first and second bases having a top side and a bottom side, said bottom side being configured to be abutted against a ground surface;

a pair of seat risers, each of said first and second bases having one of said seat risers being integrally coupled thereto, said seat risers extending upwardly from an associated one of said top sides, each one of said bench panels extending between and being attached to one of said seat risers of said first support and one of said seat risers of said second support such that each of said seat risers has one of said bench panels attached thereto;

a table riser being attached to each of said first and second bases and extending upwardly from said top sides, said tabletop being attached to said table riser and extending away from an internal surface of said table riser such that said tabletop extends between internal surfaces of said first and second supports;

said seat risers facing and being spaced from said internal surface of said table riser.

3. The table assembly according to claim 2, wherein a distance between each of said seat risers and said table riser is greater than 4.0 inches and being configured to allow a person's foot to move between said seat risers and said table riser.

4. The table assembly according to claim 3, wherein said seat risers are angled away from said table riser as said seat risers extend upwardly from an associated one of said first and second bases, an angle formed at a juncture of said top sides and said seat risers being an obtuse angle.

5. The table assembly according to claim 3, wherein each of said seat risers is angled outwardly away from said tabletop as said seat risers extending upwardly from an associated one of said first and second bases to laterally displace said bench panels from said tabletop, said seat risers having an inner edge facing each other and being angled outwardly away from each other as said inner edges extend upwardly from associated ones of said first and second bases.

6. The table assembly according to claim 2, wherein each of said seat risers is angled outwardly away from said tabletop as said seat risers extending upwardly from an associated one of said first and second bases to laterally displace said bench panels from said tabletop, said seat risers having an inner edge facing each other and being angled outwardly away from each other as said inner edges extend upwardly from associated ones of said first and second bases.

7. The table assembly according to claim 6, wherein each of said top sides of first and second bases has an interior edge, an exterior edge, a seat edge and a table edge, said interior edges of said top sides facing each other, said seat edges being attached to an associated one of said seat risers and said table edges being attached to said table riser, a juncture of said interior edges and said seat edges forming an obtuse angle, a juncture of said interior edges and said table edges forming an acute angle.

8. The table assembly according to claim 2, wherein each of said top sides of first and second bases has an interior edge, an exterior edge, a seat edge and a table edge, said interior edges of said top sides facing each other, said seat edges being attached to an associated one of said seat risers and said table edges being attached to said table riser, a juncture of said interior edges and said seat edges forming an obtuse angle, a juncture of said interior edges and said table edges forming an acute angle.

9. The table assembly according to claim 2, further including:

a pair of flanges, each of said seat risers having one of said flanges attached thereto and positioned adjacent to an upper edge thereof, said bench panels being positioned on an associated one of said flanges, a plurality of fasteners extending through said flanges and into said bench panels; and a shelf being attached to said table riser and positioned adjacent to an apex thereof, said tabletop being positioned on said shelf, a plurality of fasteners extending through said shelf and into said tabletop.

10. A table assembly comprising:

a tabletop, said tabletop having a first end and a second end;

a pair of bench panels, each of said bench panels having a first end and a second end;

a first support and a second support, each of said first and second supports having a unitary structure, said first support being coupled to each of said first ends of said tabletop and said bench panels, said second support being coupled to each of said second ends of said tabletop and said bench panels, each of said bench panels being positioned below and outwardly laterally spaced from said tabletop, each of said tabletop and said bench panels being horizontally oriented, said bench panels being coplanar;

said first support and said second support each including:

a first base and a second base, each of said first and second bases having a top side and a bottom side, said bottom side being configured to be abutted against a ground surface, said first and second bases each comprising geometrically shaped planar plate;

a first seat riser and a second seat riser, said first seat risers being attached to and extending upwardly from said first base and said second seat riser being attached to and extending upwardly from said second base;

a table riser being attached to each of said first and second bases and extending upwardly from said top sides, said first base being positioned between said table riser and an attached one of said seat risers, said second base being positioned between said table riser and an attached one of said seat risers;

said first and second seat risers being spaced at least 4.0 inches from said table riser;

said tabletop being attached to and extending between said table risers for said first and said supports;

one of said bench panels being attached to and extending between said first seat risers of said first and second supports;

one of said bench panels being attached to and extending between said second seat risers of said first and second supports.

11. The table assembly according to claim 10, wherein each of said first and second ends of said tabletop and said pair of benches being positioned entirely between said first and second supports.

12. The table assembly according to claim 10, wherein:

said first and second seat risers of said first support being angled away from table riser of said first support such that said first and second seat risers of said first support form obtuse angles with attached ones of said first and second bases; and said first and second seat risers of said second support being angled away from table riser of said second support such that said first and second seat risers of said second support form obtuse angles with attached ones of said first and second bases.

13. The table assembly according to claim 12, wherein said first and second seat risers of said first support are angled away from each other and said first and second seat risers of said second support being angled away from each other to laterally displace said bench panels outwardly away from said tabletop.

14. The table assembly according to claim 13, wherein said first base and said second base of said first support are angled away from each other as said first and second bases extend away from said table riser of said first support, said first base and said second base of said second support being angled away from each other said first and second bases extend away from said table riser of said second support.

15. The table assembly according to claim 10, wherein said first and second seat risers of said first support are angled away from each other and said first and second seat risers of said second support being angled away from each other to laterally displace said bench panels outwardly away from said tabletop.

16. The table assembly according to claim 10, wherein said first base and said second base of said first support are angled away from each other as said first and second bases extend away from said table riser of said first support, said first base and said second base of said second support being angled away from each other said first and second bases extend away from said table riser of said second support.

* * * * *